US007527585B2

(12) United States Patent
Anzini et al.

(10) Patent No.: US 7,527,585 B2
(45) Date of Patent: May 5, 2009

(54) METHODS OF MAKING RECLOSABLE PACKAGES FOR VACUUM, PRESSURE AND/OR LIQUID CONTAINMENT

(75) Inventors: David J. Anzini, Middletown, NY (US); Rusty E. Koenigkramer, Nanuet, NY (US); David J. Matthews, Gilman, IL (US); Lars G. Wihlborg, Stratford, CT (US); Glyn Russell, New City, NY (US)

(73) Assignee: Illinois Tool Works Inc., Glenview, IL (US)

( * ) Notice: Subject to any disclaimer, the term of this patent is extended or adjusted under 35 U.S.C. 154(b) by 23 days.

(21) Appl. No.: 11/257,682

(22) Filed: Oct. 25, 2005

(65) Prior Publication Data

US 2006/0111226 A1 May 25, 2006

Related U.S. Application Data

(63) Continuation-in-part of application No. 10/895,769, filed on Jul. 21, 2004, now Pat. No. 7,347,908.

(51) Int. Cl.
*B31B 1/90* (2006.01)
*B65B 61/18* (2006.01)

(52) U.S. Cl. ..... 493/214; 53/412

(58) Field of Classification Search ..... 53/412, 53/133.4, 139.2; 493/213, 214; 383/63, 383/64; 156/66
See application file for complete search history.

(56) References Cited

U.S. PATENT DOCUMENTS

| | | | | |
|---|---|---|---|---|
| 3,440,696 A | | 4/1969 | Staller | |
| 3,790,992 A | | 2/1974 | Herz | |
| 3,918,131 A | | 11/1975 | Ausnit | |
| 3,986,914 A | | 10/1976 | Howard | |
| 4,335,817 A | | 6/1982 | Bahr | |
| 4,412,879 A | * | 11/1983 | Ottaviano | 156/145 |
| 4,841,603 A | | 6/1989 | Ragni | |
| 4,961,805 A | | 10/1990 | Siebert | |
| 5,036,643 A | | 8/1991 | Bodolay | |
| 5,112,423 A | * | 5/1992 | Liebe, Jr. | 156/234 |
| 5,149,388 A | * | 9/1992 | Stahl | 156/250 |
| 5,351,369 A | | 10/1994 | Swain | |
| 5,449,427 A | * | 9/1995 | Wojnarowski et al. | 156/155 |
| 5,558,439 A | * | 9/1996 | Tilman | 383/63 |
| 5,672,009 A | | 9/1997 | Malin | |

(Continued)

FOREIGN PATENT DOCUMENTS

EP 0985605 A2 3/2000

(Continued)

*Primary Examiner*—Rinaldi I. Rada
*Assistant Examiner*—John Paradiso
(74) *Attorney, Agent, or Firm*—Ostrager Chong Flaherty & Broitman P.C.

(57) ABSTRACT

A method of manufacturing flexible containers that are hermetically resealable. Each resealable container comprises a receptacle and a pair of plastic zipper strips. The zipper strips are flattened at the ends within the side seal regions and are joined to each other, without substantial deformation of the closure profiles, in respective transition areas substantially contiguous with the side seals. These transition areas of zipper strip joinder assist in providing a leakproof transition from the openable section of the zipper to the side seals, where the closure profiles are fused and flattened (i.e., crushed).

12 Claims, 11 Drawing Sheets

U.S. PATENT DOCUMENTS

| | | | | |
|---|---|---|---|---|
| 5,829,884 | A | 11/1998 | Yeager | |
| 5,956,924 | A * | 9/1999 | Thieman | 53/412 |
| 6,033,113 | A | 3/2000 | Anderson | |
| 6,079,878 | A | 6/2000 | Yeager | |
| 6,126,765 | A * | 10/2000 | Ohman | 156/74 |
| 6,389,651 | B2 | 5/2002 | Johnson | |
| 6,767,423 | B1 | 7/2004 | Johnson | |
| 6,926,794 | B2 * | 8/2005 | Kohama et al. | 156/308.2 |
| 2001/0046334 | A1 | 11/2001 | Yeager | |
| 2003/0147565 | A1 | 8/2003 | Plourde et al. | |
| 2003/0169948 | A1 * | 9/2003 | Fenzl et al. | 383/61.2 |
| 2005/0063620 | A1 | 3/2005 | Anderson | |

FOREIGN PATENT DOCUMENTS

| | | | |
|---|---|---|---|
| EP | 1407681 | A2 | 4/2004 |
| GB | 1399502 | | 7/1975 |
| WO | WO 00/76352 | A1 | 12/2000 |
| WO | WO 03/003871 | A1 | 1/2003 |
| WO | WO 2005/092726 | A1 | 10/2005 |

* cited by examiner

METHODS OF MAKING RECLOSABLE PACKAGES FOR VACUUM, PRESSURE AND/OR LIQUID CONTAINMENT

RELATED PATENT APPLICATION

This application is a continuation-in-part of and claims priority from U.S. patent application Ser. No. 10/895,769 filed on Jul. 21, 2004 now U.S. Pat. No. 7,347,908 and entitled "Leakproof Zipper End Crush for Reclosable Bag and Related Method of Manufacture".

BACKGROUND OF THE INVENTION

This invention generally relates to flexible containers, such as pouches, bags or other packages, having a reclosable plastic zipper. In particular, the invention relates to reclosable bags, pouches or other packages for containing vacuum, pressure or liquid.

To ensure hermeticity or airtightness, packagers have typically sealed their flexible containers to an extent that they are not reclosable after the seal is broken. Many flexible containers that were reclosable typically did not retain the desired vacuum, pressure or liquid containment feature that existed prior to the container being opened for the first time.

In many different applications, it is desirable to provide a reclosable container that, under normal or expected conditions of usage, will not leak fluid when the zipper is closed. Such a container should maintain a leakproof condition even when there is a large differential in pressure between the interior and exterior of the container. As used herein, the term "leakproof" does not mean free of leaks under all temperature/pressure conditions, but rather free of leaks over a range of temperatures and pressures expected to occur during normal usage of the reclosable container.

In the case of known collapsible, evacuable, zippered storage bags, the zipper is opened; an article is placed inside the bag; the zipper is closed, and then the bag is evacuated using a fixture that penetrates a bag wall. With the bag thus evacuated, a compressible article contained therein may be significantly compressed so that it is easier to transport and requires substantially less storage space. It is highly desirable that ambient air not leak into the evacuated interior space of the bag. Such leakage would cause a loss of vacuum. Also it is highly desirable that the zipper not open unintentionally due to mechanical forces that occur during bag manipulation.

Collapsible, evacuable storage bags are beneficial for reasons in addition to those associated with compression of the stored article. For example, removal of the air from the storage bag inhibits the growth of destructive organisms, such as moths, silverfish, and bacteria, which require oxygen to survive and propagate. Moreover, such bags, if properly sealed, are impervious to moisture, as a consequence of which the growth of mildew is inhibited.

Not only large, compressible items such as clothing may be stored in a collapsible, evacuable and reclosable storage bag. For example, it may be desirable to store bulk items made of small particles, such as powders or granulated resins, in an evacuated reclosable bag. The stored material may be of a type that, when exposed to air during storage, is rendered unsuitable for its intended purpose. If the reclosable bag were made leakproof, then the bulk contents inside the bag would not be exposed to air.

In accordance with another application, a reclosable storage bag may be filled at ambient atmosphere instead of being evacuated. If such a bag were placed under extremely low pressure, e.g., while being air-lifted via a cargo plane having a depressurized cargo bay, then a large differential in pressure would exist between the interior and exterior of the bag. In this situation, the internal pressure may be about 15 psi, while the external pressure is negligible. It is desirable that the bag not develop a leak and that the zipper not pop open under such conditions.

Another use for evacuable reclosable packages is in the field of food product packaging. After a package of food has been opened and a portion of the food product removed, the remaining food product can be stored by closing the reclosable feature and then evacuating the interior space of the package via a fixture that penetrates a package wall. It is highly desirable that such packages, containing perishable food product in a vacuum, be leakproof, i.e., hermetic. By preventing exposure to air, the life span of the perishable food product can be extended.

In other situations, it is desirable to provide a reclosable package capable of holding liquid without leaking during normal usage when the zipper is reclosed. Preferably such a package would be able to withstand a predetermined pressure differential (interior/exterior) without liquid leaking out of the package.

In a typical construction, a reclosable pouch, bag or other package has a plastic zipper comprising two extruded zipper strips, the ends of the zipper strips extending into the side seals of a flexible receptacle. Frequently, each zipper strip comprises a closure profile and a flange or fin portion (hereinafter "flange"). The zipper strips are joined to the web of web material by heat sealing the web to the zipper flanges. In order to facilitate the formation of a tight side seal, typically the ends of the zipper strips are crushed. During the crushing operation, heat and pressure are applied in sufficient amounts (e.g., by means of mutually opposing heated sealing bars) that the ends of the zipper strips soften or melt and then deform. The flattened ends of the zipper strips then fuse during cooling. This thermal crushing operation is typically done at a separate thermal crush station or as part of the formation of a side seal of the receptacle at a cross sealing station. This "thermal crushing" of the plastic zipper creates a transition between "as is" (i.e., not crushed) zipper and crushed zipper that is susceptible to the presence of leaks.

There is a continuing need for improvements in the construction of reclosable containers having a hermetic interior volume when the zipper is reclosed. In particular, there is a need for an improved reclosable container wherein leakage is eliminated in those areas of the zipper near the container side seals.

BRIEF DESCRIPTION OF THE INVENTION

Flexible containers that are hermetically resealable are disclosed herein. Each resealable container comprises a receptacle and a pair of plastic zipper strips. The zipper strips are flattened at the ends within the side seal regions and are joined to each other, without substantial deformation of the closure profiles, in respective transition areas substantially contiguous with the side seals. These transition areas of zipper strip joinder assist in providing a leakproof transition from the openable section of the zipper to the side seals, where the closure profiles are fused and flattened (i.e., crushed). The present invention is directed to methods of manufacturing reclosable containers having the foregoing features.

One aspect of the invention is a method of manufacture comprising the following steps: (a) joining first and second zipper strips of a plastic zipper to web material, the first zipper strip comprising a first closure profile and a first flange extending from the first closure profile, the second zipper strip comprising a second closure profile and a second flange extending from the second closure profile, the first and second closure profiles in combination comprising at least three projecting elements, and the first zipper strip further comprising a third flange extending from the first closure profile in a direction opposite to that of the first flange, the first through third flanges being joined to the web material; (b) before or after step (a) has been performed, arranging the web material such that first and second sections are mutually opposed; (c) after steps (a) and (b) have been performed, applying heat and pressure along first and second band-shaped zones that are substantially orthogonal to the joined zipper strips and extend at least from the zipper strips to the portions of the first and second sections of the web material that are furthest away from the zipper strips, the heat and pressure being sufficient to melt the portions of the web material that lie within the first and second band-shaped zones, and to melt and flatten the portions of the zipper that lie within the first and second band-shaped zones; (d) before step (c) is performed, applying heat and pressure or ultrasonic vibrations and pressure in first and second transition regions having intermediate portions that will be respectively overlapped by the first and second zones in step (c), heat and pressure or ultrasonic vibrations and pressure being applied to an extent that upon completion of step (d), the projecting elements of the closure profiles that are furthest apart from each other will become fused to respective portions of the other zipper strip in the first and second transition regions, and the first and second closure profiles will be heated but not flattened in the first and second transition regions, wherein upon completion of steps (c) and (d), the unflattened portions of the first and second closure profiles in the first transition region form first and second transition areas on opposite sides of a first flattened section of the first and second closure profiles, and the unflattened portions of the first and second closure profiles in the second transition region form third and fourth transition areas on opposite sides of a second flattened section of the first and second closure profiles; (e) after step (c) has been performed, applying pressure in the first and second transition regions to an extent that surface irregularities formed on the first through third flanges during step (c) are flattened without flattening the first through fourth transition areas; and (f) cutting the web material and the first and second zipper strips along first and second lines that respectively intersect the first and second zones and extend the full height of the web material.

Another aspect of the invention is a method of manufacture comprising the following steps: (a) joining a first flange of a length of a first zipper strip made of thermoplastic material to a first portion of a web material, the first zipper strip further comprising a first closure profile, the first flange extending from the first closure profile; (b) joining a second flange of an equal length of a second zipper strip made of thermoplastic material to a second portion of the web material, the second zipper strip further comprising a second closure profile, the second flange extending from the second closure profile; (c) after steps (a) and (b) have been performed and while the first and second closure profiles are interlocked along the length of the first and second zipper strips, pressing respective first sections of the first and second flanges between a first pair of bars having mutually opposed flat surfaces on each side of a pair of mutually opposed straight grooves, the first pair of bars being energized and applying pressure to the extent that upon completion of step (c), the first sections of the first and second flanges are melted while the first sections of the first and second closure profiles are softened and not flattened; (d) after step (c) has been performed, pressing intermediate portions of the first sections of the first and second closure profiles and of the first and second flanges and mutually confronting third and fourth portions of the web material between mutually opposing flat surfaces of a second pair of bars, wherein the third and fourth portions of the web material do not overlap any portions of and extend substantially orthogonal to the first and second zipper strips, the second pair of bars being energized and applying pressure to the extent that upon completion of step (d), the third and fourth portions of the web material are melted, and the intermediate portions of the first sections of the first and second closure profiles are melted and flattened; (e) after step (d) has been performed, pressing the respective first sections of the first and second flanges and the respective first sections of the first and second closure profiles between a third pair of bars having mutually opposed flat surfaces on each side of a pair of mutually opposed straight grooves, the third pair of bars applying pressure to an extent that upon completion of step (e), surface irregularities on the joined first sections of the first and second flanges are flattened without flattening any further portion of the first sections of the first and second closure profiles; and (f) after step (e) has been performed, cutting the web material and the first and second zipper strips along a first line that intersects and extends the full height of the web material.

A further aspect of the invention is a method of manufacture comprising the following steps: (a) interlocking a first closure profile of a length of a first zipper strip made of thermoplastic material with a second closure profile of an equal length of a second zipper strip made of thermoplastic material, the first and second zipper strips respectively further comprising first and second flanges respectively extending in the same direction from the first and second closure profiles, and the first zipper strip further comprising a third flange extending in a direction opposite to the direction in which the first flange extends; (b) joining the first through third flanges of the lengths of the first and second zipper strips to first through third portions respectively of a web material along first through third band-shaped zones of joinder respectively; (c) after steps (a) and (b) have been performed, supplying energy into first, second and third volumes forming a first section of the lengths of the first and second zipper strips, the third volume being disposed between the first and second volumes, the third volume being occupied by respective first sections of the first and second closure profiles, the first volume being occupied by respective first sections of the first and second flanges, and the second volume being occupied by a first section of the third flange, wherein the respective first sections of the first and second closure profiles are heated without being flattened during step (c) and the respective first sections of the first and second flanges will become joined upon completion of step (c); (d) after step (c) has been performed, applying pressure to and supplying energy over a first side seal region that intersects intermediate portions of the first sections of the first and second closure profiles and the first through third flanges and that intersects mutually confronting fourth and fifth portions of the web material, whereby the fourth and fifth portions of the web material will become joined to each other and to the intermediate portion of the first section of the third flange, and the intermediate portions of the first sections of the first and second closure profiles are flattened; (e) after step (d) has been performed, applying pressure on the respective first sections of the first and second flanges without flattening any unflattened portions of the first sections of the first and second closure profiles; and (f) after step (e) has been performed, cutting the web material and the first and second zipper strips along a first line that intersects and extends the full height of the first side seal region.

Yet another aspect of the invention is a method of leakproofing an end of a plastic zipper comprising first and second zipper strips joined to respective portions of a web material, the first zipper strip comprising a first closure profile and a first flange extending from the first closure profile, the second zipper strip comprising a second closure profile and a second flange extending from the second closure profile, the first and second closure profiles in combination comprising at least three projecting elements, and the first zipper strip further comprising a third flange extending from the first closure profile in a direction opposite to that of the first flange, the method comprising the following steps: (a) applying heat and pressure or ultrasonic vibrations and pressure to a section of the zipper, heat and pressure or ultrasonic vibrations and pressure being applied to an extent that upon completion of step (a), the projecting elements of the zipper that are furthest apart from each other will become fused to respective confronting portions of the zipper in the zipper section, and the first and second closure profiles will be heated but not flattened in the zipper section; (b) after step (a) has been performed, thermally crushing a portion of the zipper section, the crush area extending the full height of the zipper from flange edge to flange edge, the first and second closure profiles being flattened in the crushed portion of the zipper section; and (c) after step (b), applying pressure on the zipper section to an extent that surface irregularities formed on the first through third flanges during step (b) are flattened without flattening any further portion of the first and second closure profiles in the zipper section.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
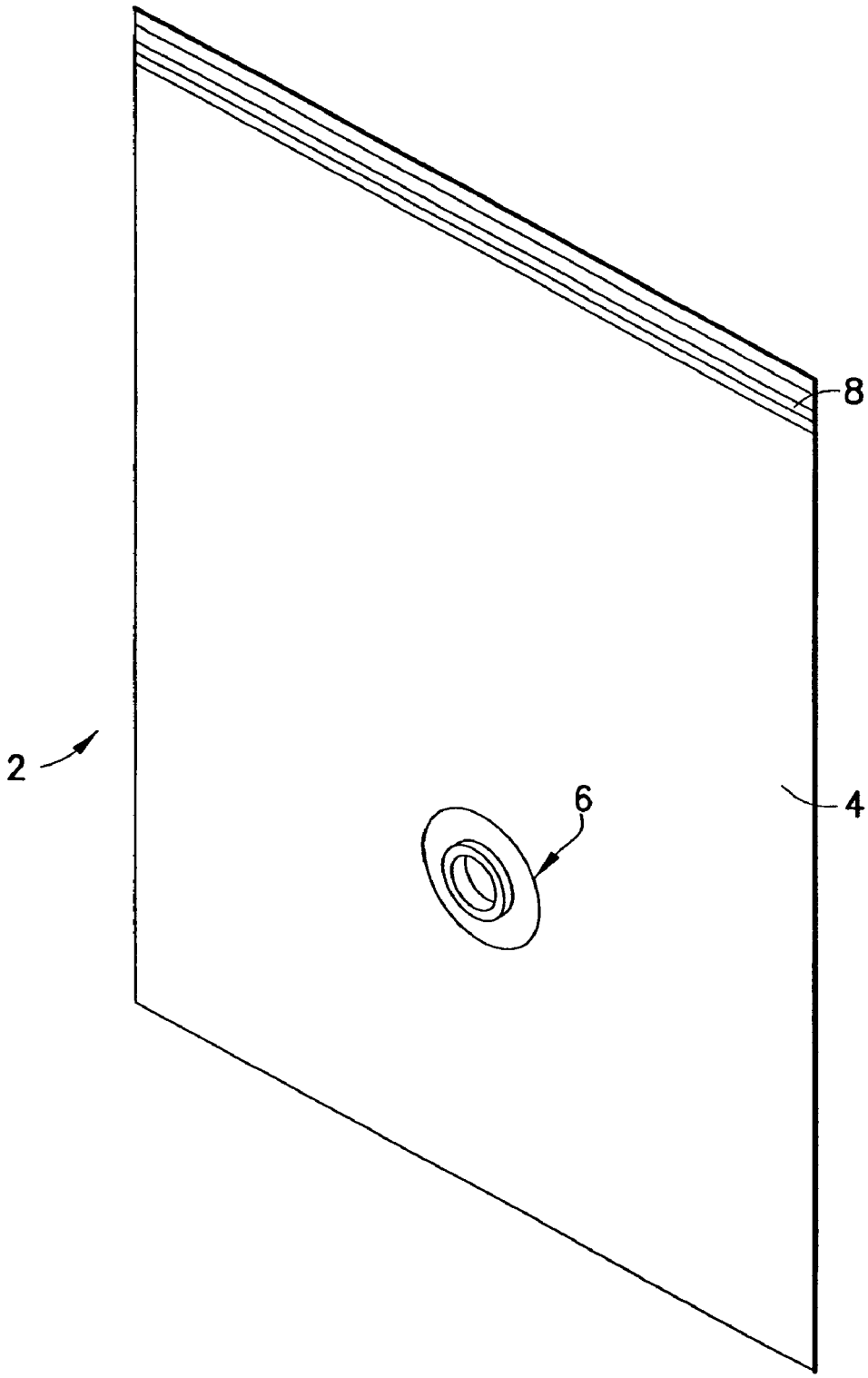
FIG. 1 PRIOR ART
FIG. 1 is a drawing showing an isometric view of one conventional type of collapsible, evacuable storage bag.

FIG. 1 shows a conventional collapsible, evacuable storage bag 2 comprising a receptacle 4, a valve assembly 6, and a zipper 8 comprising a pair of mutually interlockable extruded zipper strips that are joined to each other at opposing ends thereof. Although not shown in FIG. 1, the conventional valve assembly 6 also typically comprises a cap that can be snapped onto a portion of the valve assembly that is disposed on the exterior of the receptacle 4. The cap must be removed before the receptacle can be evacuated, and then is replaced after the receptacle has been evacuated. The cap is intended to seal the valve assembly to prevent air from entering the evacuated receptacle.

The receptacle 4 typically comprises front and rear walls or panels (typically made of thermoplastic film material) that are joined together at the bottom and two sides by conduction heat sealing to form a receptacle having an interior volume and a mouth in which the zipper 8 is installed. Alternatively, the receptacle 4 may be made from a web of film that is folded, the fold forming the bottom of the receptacle. One wall of receptacle 4 has a hole (not shown in FIG. 1) in which to install the valve assembly 6. The receptacle may be constructed of a blended extrusion layer of polyethylene sandwiched between a nylon layer and a layer of polyethylene sheeting. However, the materials comprising the receptacle may be altered so as to prevent interaction with the contents stored therein.

During use, one or more discrete articles or a bulk material (not shown) may be placed inside the receptacle 4 while the zipper 8 is open, i.e., while the closure profiles of the interlockable zipper strips are disengaged from each other. After the article or material to be stored has been placed inside the receptacle, the mouth of the receptacle 4 can be sealed by pressing the zipper strips together to cause their respective closure profiles to interlock with each other. Although the zipper closure profiles may have many different designs, the design must be one that ensures that an airtight seal can be formed at the mouth of the receptacle.

The zipper strips can be pressed together using a device (not shown in FIG. 1) commonly referred to as a "slider" or "clip", which straddles the zipper. The typical slider has a generally U-shaped profile, with respective legs disposed on opposing sides of the zipper. The gap between the slider legs is small enough that the zipper can pass through the slider gap only if the zipper is in a closed state. Thus when the slider is moved along an open zipper, this has the effect of pressing the incoming sections of the zipper strips together. The zipper is opened by pulling apart the zipper upper flanges, as explained in more detail below. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

The zipper 8 is designed to form a hermetic seal at the mouth of the receptacle 4 when the zipper 8 closed. After the zipper has been closed, the interior volume of the receptacle can be evacuated by sucking air out via the one-way valve assembly 6. Air can be drawn out of receptacle 4 through valve assembly 6 using a conventional vacuum source, such as a household or industrial vacuum cleaner. The valve assembly 6 and the zipper 8 maintain the vacuum inside receptacle 4 after the vacuum source is removed.

The front and rear wall panels of the receptacle 4 are respectively sealed to the zipper strip by lengthwise conduction heat sealing in conventional manner. Alternatively, the interlockable zipper strips can be attached to the wall panels by adhesive or bonding strips or the zipper profiles can be extruded integrally with the web material. The walls of the receptacle may be formed of various types of gas-impermeable thermoplastic web material. The preferred gas-impermeable thermoplastics are nylon, polyester, polyvinyl dichloride and ethylene vinyl alcohol. The web material may be either transparent or opaque.

Figure 2:
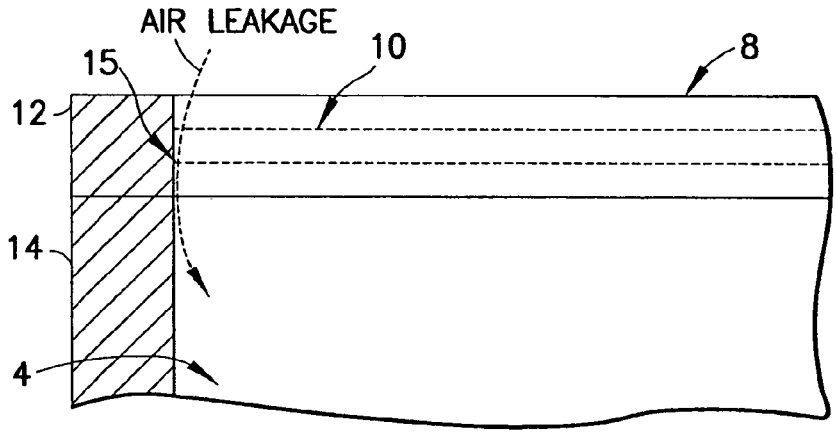
FIG.2 PRIOR ART
FIG. 2 is a drawing showing a portion of a conventional reclosable storage bag having thermal side seals.

In many reclosable bags, the zipper comprises a pair of mutually interlockable zipper strips, each zipper strip having a respective generally constant profile along the interlockable portion of the zipper. Each zipper strip further comprises upper and lower flanges that extend from the respective closure profile in opposite direction. Each flange is a thin web of the same material used to make the closure profiles. The upper flanges serve as pull flanges that can be gripped and pulled apart to open the zipper. Typically, the ends of the zipper strips are joined together at the sides of the bag. A representative zipper joint is shown in FIG. 2, which depicts one corner of such a reclosable bag. The dashed lines denote a central portion 10 of the zipper 8 comprising interlockable closure profiles, each closure profile comprising a respective plurality of profiled closure elements. The ends of the zipper strips are fused together in area 12 at the same time that the container side seals 14 are formed. If the bag walls extend upward and above the upper zipper flanges, then the side seals typically extend upward as far as the top edges of such upstanding panels. The side seals are typically formed by applying heat and pressure in amounts sufficient to fuse and flatten the closure profiles at the ends of the zipper, which process is often called "thermal crushing".

Thermal crushing of the interlockable profiled closure elements in region 10 of the zipper 8 creates a transition 15 between uncrushed zipper and crushed zipper that is susceptible to the presence of leaks through which fluid (gas or liquid) can enter or exit an evacuated container. Such leakage is indicated by the dashed arrow in FIG. 2. [For the sake of simplicity, the transition 15 between uncrushed zipper and crushed zipper has been represented as a straight line in FIG. 2. However, a person skilled in the art will recognize that thermoplastic material, when melted or rendered molten, is unlikely to fuse in a manner that forms a perfectly straight line.]

Figure 3:
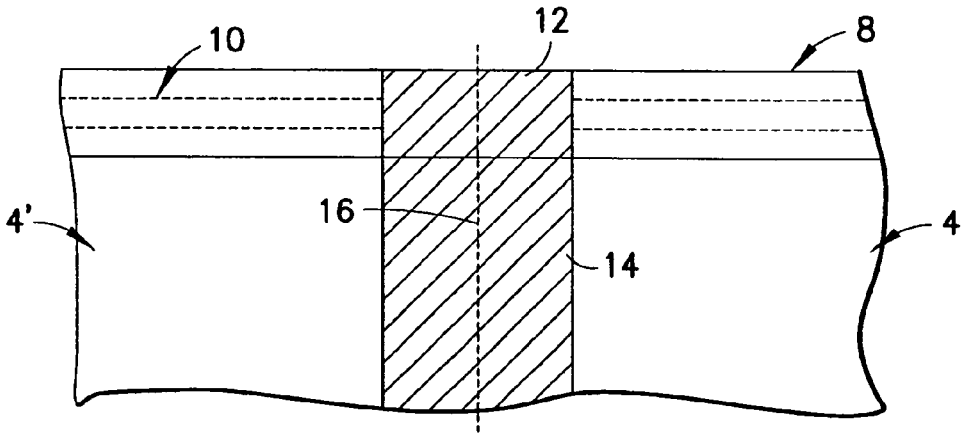
FIG. 3 is a drawing showing a stage in the manufacture of the reclosable storage bag depicted in FIG. 2.

During manufacture, the cross seals are made wide enough so that respective halves of the heat sealed area 14 can be incorporated into two bags, as seen in FIG. 3. The cross-sealed area 14 is bisected by cutting along a line 16 transverse to the zipper 8. The area to the right of the cut line 16 forms the trailing cross seal of the leading receptacle 4 (assuming advancement of the chain of receptacles from left to right in FIG. 3), while the area to the left of the cut line 16 forms the leading cross seal of the trailing receptacle 4'.

An evacuable storage bag may be constructed from two panels of film joined together (e.g., by conduction heat sealing) along three sides of a rectangle. Alternatively, the bag may be constructed by folding a web of film and heat sealing the confronting sides of the folded web in side seal regions. To maintain a vacuum inside the storage bag, the zipper in a closed state must provide a hermetic seal at the mouth (i.e., fourth side) of the bag. Also the thermally crushed ends of the zipper must be leakproof under the temperature/pressure conditions to be expected during normal usage.

In U.S. patent application Ser. No. 10/896,769, it was proposed to eliminate air leakage into an evacuated storage bag at the zipper joints by providing a transition area between the crushed and uncrushed closure profiles wherein the closure profiles have been fused together without flattening. Above and below the transition area, the zipper flanges are fused together. This was accomplished first by applying pressure and supplying ultrasonic energy in a section of the zipper indicated by cross hatching in FIG. 4. Respective sections of the upper flanges are melted in zone 18; respective sections of the lower flanges are melted in zone 20; and respective sections of the closure profiles are softened without flattening in zone 22. Then intermediate portions of zones 18, 20 and 22 are thermally crushed to form a side seal region 14, indicated by different cross hatching in FIG. 5, leaving unflattened transition areas 22*a* and 22*b* on opposite sides of the side seal.

Figure 5:
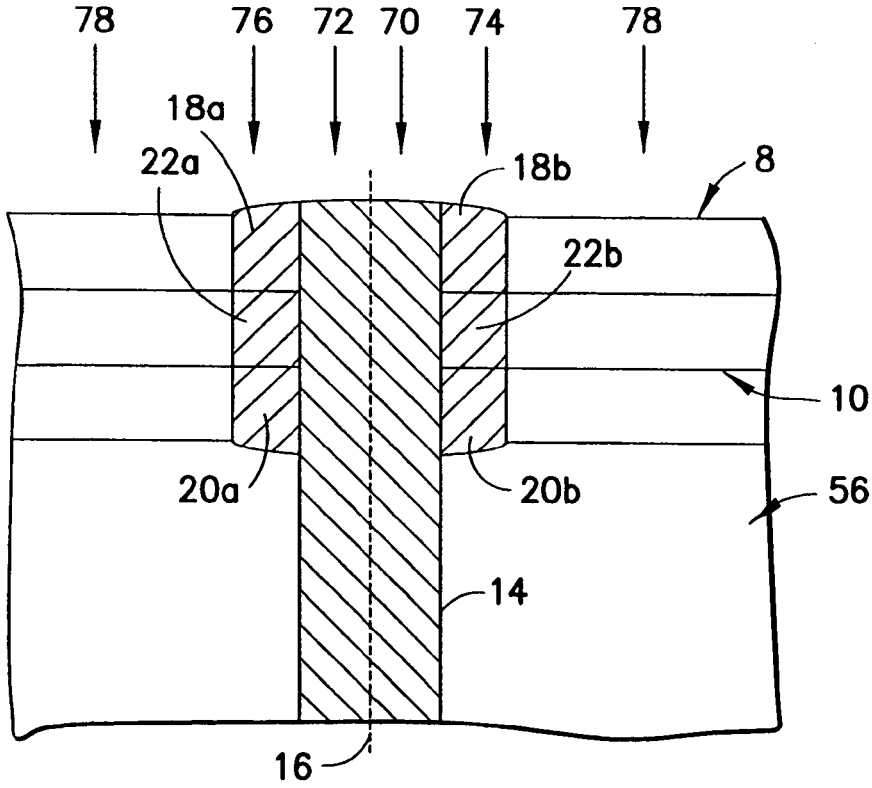

Still referring to FIG. 5, in the area between transition areas 22*a* and 22*b*, the closure profiles are flattened during side sealing. During flattening, the thermoplastic material of the flattened sections of the closure profiles spreads and melds with thermoplastic material of the upper and lower flanges and the web material. Above the transition areas 22*a* and 22*b*, the upper flanges remain fused together in zones 18*a* and 18*b*. Below the transition areas 22*a* and 22*b*, the lower flanges remain fused together in zones 20*a* and 20*b*.

Figure 4:
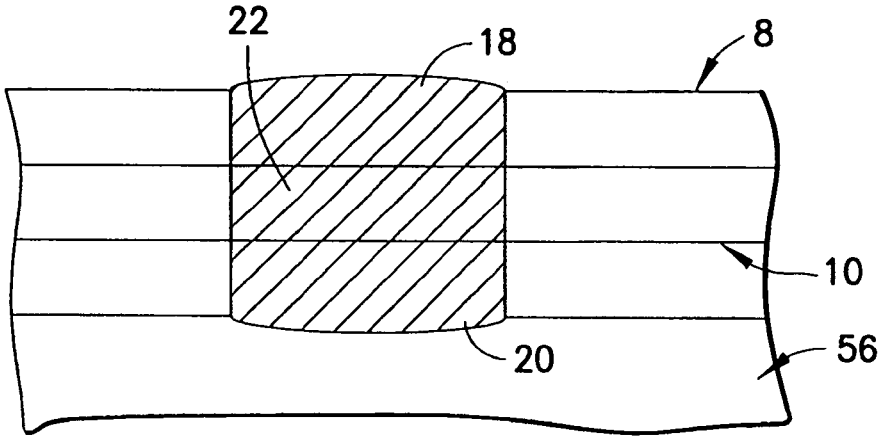
FIGS. 4 and 5 are drawings showing respective stages in accordance with one method for making leakproof zipper end seals in a collapsible, evacuable, reclosable storage bag of the type shown in FIG. 1.

As disclosed in U.S. patent application Ser. No. 10/896,769, the foregoing was accomplished by ultrasonically welding the zipper strips together in the cross-hatched region seen in FIG. 4 using a horn and an anvil having mutually confronting recessed faces. More specifically, the horn and anvil each have a groove disposed between two coplanar flat surfaces. During welding, the coplanar surfaces of the horn respectively confront the coplanar surfaces of the anvil, while the groove of the horn confronts the groove of the anvil. The groove of the anvil is used to guide the zipper relative to the horn during zipper/film advancement, and also assists the groove of the horn to "contain" and provide clearance for the closure profiles in the transition area during welding. The surfaces of the grooves are shaped to contact the intervening sections of the closure profiles during welding (i.e., when the horn and anvil are brought together) with an amount of pressure that is sufficient to ensure acoustic coupling of the horn to the zipper strips, but not so great as to cause the profiled interlockable closure elements to undergo substantial deformation. One pair of the confronting flat surfaces of the horn and anvil weld the zipper upper flanges together, while the other pair of confronting flat surfaces weld the zipper lower flanges together. FIG. 4 shows a portion of a zipper sandwiched between and already joined (e.g., by conduction heat sealing) to marginal portions of respective webs of film material. Only the front web 56 is indicated in this view. [For the sake of illustration, it is assumed that the film material of web 56 is optically transparent, so that the zipper is visible in FIG. 4.] Welded zone 22 includes the material that occupies the aforementioned grooves in the horn and anvil during the welding operation.

After respective sections of the zipper strips have been joined by ultrasonically welding in zones 18, 20 and 22 (shown in FIG. 4), the opposing webs of packaging film and the continuous zipper strips joined thereto are advanced one package length or multiple package lengths on a machine. At the next work station, the panels are cross sealed by conduction heat sealing. More specifically, sufficient heat and pressure are applied in a strip-shaped zone 14 (see FIG. 5), which extends transverse to the zipper 8, to thermally crush the zipper strips and join the panels together across the full height of the panels. The cross seal 14 overlaps with the area (indicated by cross hatching in FIG. 4) in which the zipper strips were ultrasonically welded together. As seen in FIG. 5, the width of the cross seal 14 is less than the width of the area in which the zipper strips have been ultrasonically welded together and overlaps an intermediate portion thereof. Within this zone of overlap, the central region 10 (i.e., the closure profiles) of the zipper 8 is thermally crushed, i.e., flattened. As a result, the profiled interlockable closure elements of each zipper strip undergo substantial deformation.

As seen in FIG. 5, the cross seal 14 at the zipper is inboard of the ultrasonic weld. Preferably a line of symmetry of the ultrasonically welded regions is generally collinear with a centerline of the cross seal 14, which are in turn generally collinear with a line of cutting, indicated by the dashed line 16. However, precise collinearity is not required. When the zipper 8 and packaging film are cut along line 16, the package on one side of line 16 will be separated from the unsevered package on the other side of line 16, and the cross seal 14 will be divided into respective side seals on the respective packages.

In accordance with the teaching of U.S. patent application Ser. No. 10/896,769, the uncut web/zipper assembly comprises three distinct structures: (a) respective thermally crushed zipper sections 70, 72 (that will be severed at the cut line 16) in which the zipper strips are fused together and the closure profiles are deformed; (b) respective ultrasonically welded zipper sections 74, 76 substantially contiguous with the thermally crushed zipper sections 70, 72, in which the zipper strips are fused together and the closure profiles are fused without substantial deformation, thus forming the aforementioned transition areas 22*a* and 22*b*); and (c) the remaining zipper sections 78 (having one end substantially contiguous with a corresponding ultrasonically welded section) in which the zipper strips are interlockable and disengageable (i.e., the closure profiles are neither deformed nor fused together).

In order to produce a reclosable pouch, bag or package that will contain vacuum, pressure and/or liquids, it was determined that there should be hard and intimate contact between the closure profiles when the zipper is closed. More specifically, it was determined that, in order to ensure that the zipper performs its containment function in an acceptable manner, the percentage of the area of intimate contact between closure profiles should lie within a predetermined range. As used herein, the term "intimate contact", in the context of a closed zipper, means those portions of the area at the interface of the interlocked closure profiles that do not show any clearance between the respective closure profile elements, such as hooked elements and posts or backup elements, when viewed under a microscope. The areas without clearance can be displayed by cutting the zipper with a razor blade and placing the cross section under magnification. A magnified image of the closure profiles (i.e., a so-called "shadowgraph") is produced, and then the portions of the profiles that display intimate contact can be marked on the image.

The minimum and maximum intimate contact area may be expressed as percentage, whereby the area of lineal contact is divided by the total available lineal surface of one profile. It was determined that the minimum percentage of intimate contact area that would still enable the zipper to perform satisfactorily as a containment zipper was 33%, whereas the maximum percentage of intimate contact area that would still enable the zipper to open and reclose was 76%. It is believed that any zipper having an intimate contact area percentage in the range of 33 to 76% can be effectively placed in a reclosable package that will contain vacuum, pressure and/or liquid during normal usage. Once a containment zipper has been selected, the package designer must then select a proper film strength and film seal integrity for the specific application.

Furthermore, the respective closure profiles of the zipper should have the same shape and configuration of elements, so that thermoplastic zipper material is substantially symmetrically and evenly distributed across the interlocked profiles. This will facilitate the formation of zipper end stomps or joints having flat surfaces and constant thickness.

If the minimum design criteria for the closure profiles are met, the reclosable package will only be limited by the material strength of the package components, i.e., the web material, the web-to-web and web-to-zipper seals, and the zipper material.

Many different types of zippers are suitable for use as containment zippers. In accordance with various embodiments disclosed hereinafter, a containment zipper is incorporated into a pouch or bag in such a way that the pouch or bag is able to withstand a large pressure differential between the interior and the exterior of the pouch or bag without leaking or popping open. Alternatively, the pouch or bag is suitable for containing liquid without leaking or popping open under the expected conditions of normal usage.

Figure 6:
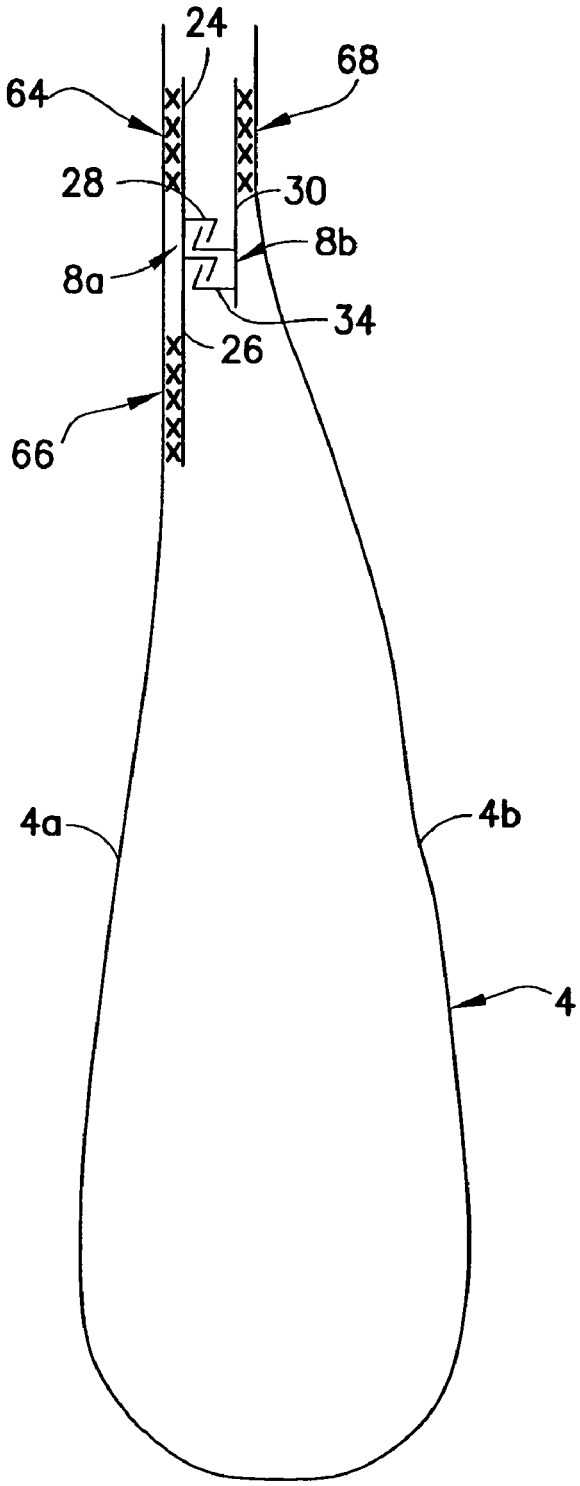
FIG. 6 is a drawing showing a schematic representation of the cross section of a reclosable bag for vacuum, pressure or liquid containment in accordance with one embodiment of the present invention.

A reclosable pouch or bag in accordance with one embodiment of the invention is schematically represented in cross section in FIG. 6. The reclosable bag comprises a receptacle 4 with a three-flange containment zipper installed in the receptacle mouth at a top of the bag. One strip 8*a* of the containment zipper comprises a closure profile 28 and upper and lower flanges 24 and 26 extending in opposite directions from closure profile 28. The upper and lower flanges 24 and 26 are heat sealed to one wall or panel 4*a* of the receptacle in respective band-shaped zones 64 and 66 indicated by Xs in FIG. 6. Each band-shaped zone 64, 66 extends the length of the flanges. The other zipper strip 8*b* comprises a closure profile 34 and an upper flange 30 that confronts the upper flange 24. The upper flange 30 is heat sealed to the other wall or panel 4*b* of the receptacle 4 in a band-shaped zone 68 extending the length of the flange. By sealing zipper strip 8*b* to the receptacle 4 only at a flange 30 located above the closure profiles, a positive leverage effect is created, whereby pressure in the interior of the receptacle or mechanical forces exerted on the receptacle will, at least at the lower levels, tend to pull the receptacle wall 4*b* away from the closure profile 34, rather than pulling closure profile 34 away from closure profile 28. In contrast, if both zipper strips had upper and lower flanges and all four flanges were sealed to the sides of the receptacle, the sufficiently high internal pressure could produce enough stress that the closure profiles would be pulled apart, thereby opening the zipper and breaking the containment.

The upper flanges 24 and 30 can be gripped by the user and pulled apart to open the closed zipper. The opened zipper can be reclosed by manually pressing the zipper strips together along the entire length of the zipper with sufficient force to cause the closure profiles to interlock. Alternatively, a slider (not shown) can be used to close the zipper. Typically, such a slider takes the form of a U-shaped clip that fits over the zipper with clearance for the upper flanges, while the legs of the clip cam the zipper profiles of the incoming zipper section into engagement when the slider is moved along the zipper in either direction.

The structure of the containment zipper is only schematically represented in FIG. 6. The structure of an exemplary containment zipper, suitable for incorporation in the bag seen in FIG. 6, is shown in detail in FIG. 7. One zipper strip 8*a* comprises a closure profile 28 and upper and lower flanges 24 and 26 extending in opposite directions therefrom. The closure profile 28 comprises a pair of monohook elements and a post or backup element devoid of a hook. A portion of the outer surface of upper flange 24 is coated with a layer 38 of low-melting thermoplastic material (hereinafter "sealant layer") to facilitate heat sealing of the upper flange 38 to one receptacle wall. The lower flange 26 has a similar sealant layer 36 thereon. The other zipper strip 8*b* comprises a closure profile 34, an upper flange 30 that confronts the upper flange 24, and a short extension 32 that confronts minor portion of the lower flange 26. The closure profile 34 also comprises a pair of monohook elements and a post or backup element devoid of a hook. A portion of the outer surface of upper flange 30 is coated with a sealant layer 40 to facilitate heat sealing of the upper flange 38 to the other receptacle wall.

Figure 7:
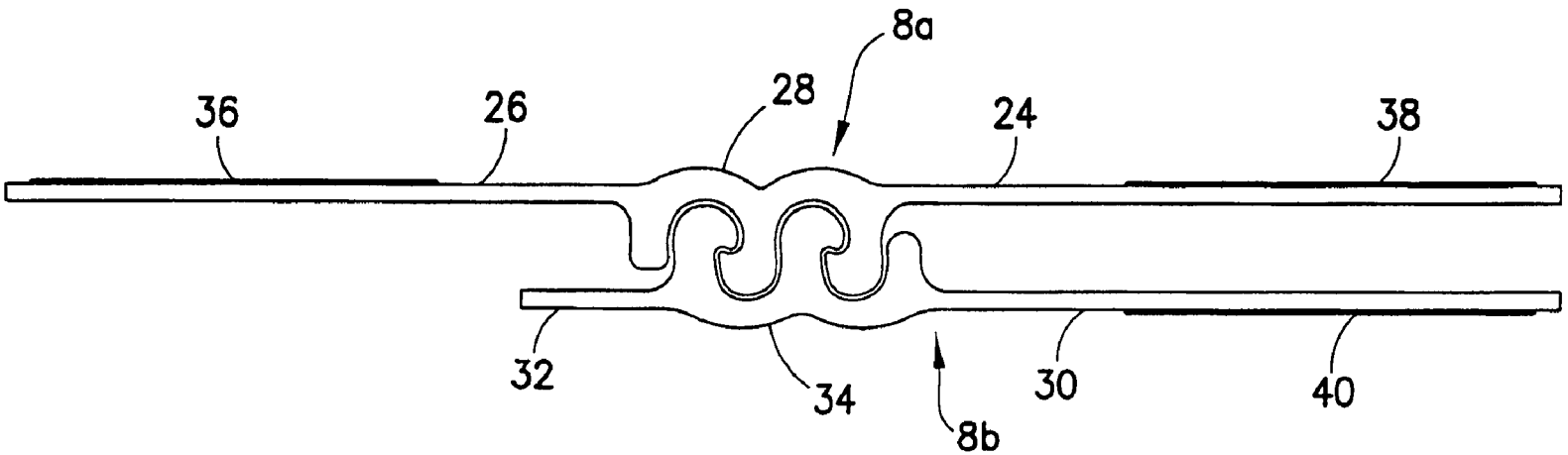
FIG. 7 is a drawing showing a cross-sectional view of a zipper that is suitable for use as a containment zipper in bags of the type schematically depicted in FIG. 6.
Figure 8:
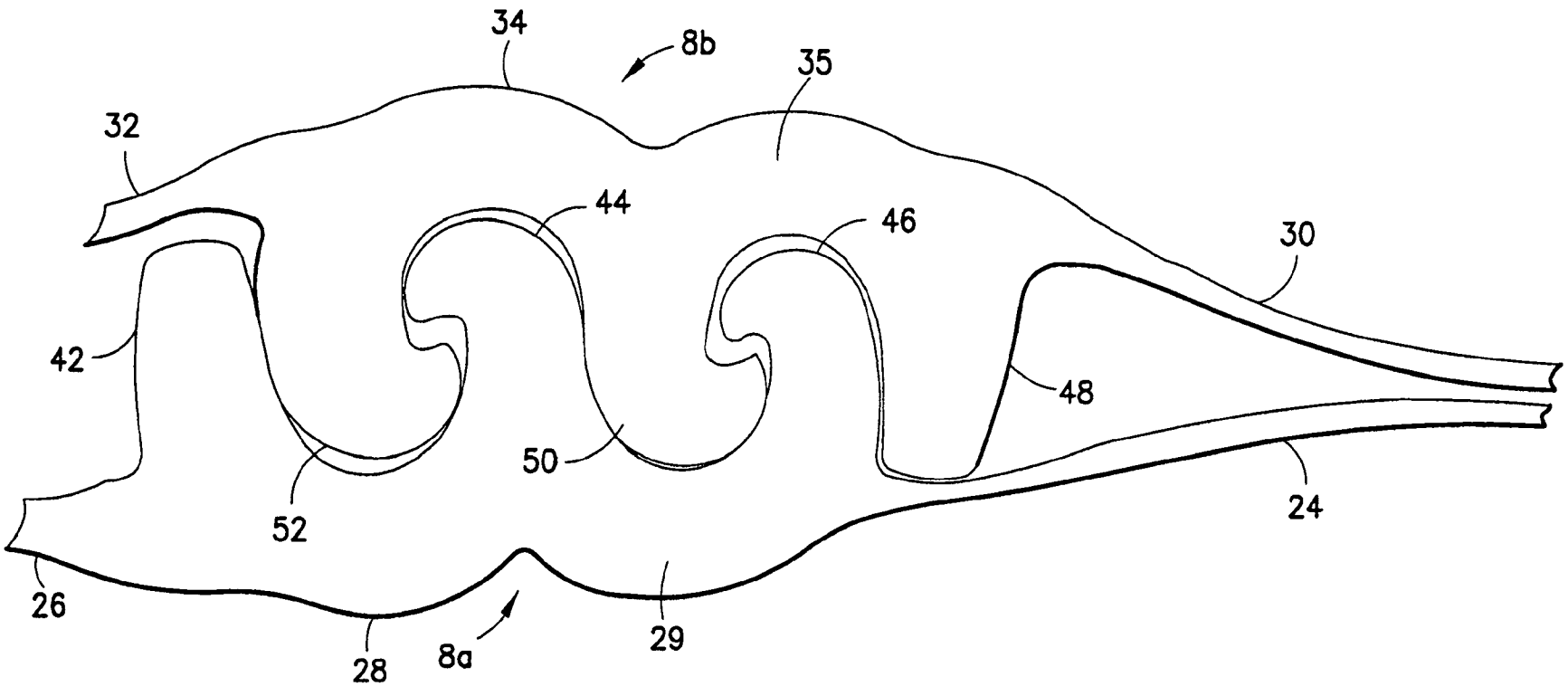
FIG. 8 is a drawing showing in detail the closure profiles of the zipper depicted in FIG. 7.

The three-flange zipper seen in FIG. 7 is shown on an enlarged scale in FIG. 8. The closure profile 28 comprises three profiled closure elements 42, 44 and 46 projecting from a base 29, the upper and lower flanges 24 and 26 having respective ends integrally formed with base 29. Elements 44 and 46 are monohook elements, while element 42 is a post having no hook. Similarly, the closure profile 34 comprises three profiled closure elements 48, 50 and 52 projecting from a base 35, the upper flange 30 and the short extension 32 having respective ends integrally formed with base 35. Elements 50 and 52 are monohook elements, while element 48 is a post having no hook. When the closure profiles are fully interlocked, as shown in FIG. 8, monohook element 52 of closure profile 34 is disposed in a recess defined by and is in contact with post 42 and monohook element 44 of closure profile 28; the monohook element 44 of closure profile 28 is disposed in a recess defined by and is in contact with monohook elements 50 and 52 of closure profile 34; and so forth. The intimate contact area between the respective closure profiles lies within the aforementioned percentage range that is suitable for use as a containment zipper.

To ensure that a reclosable bag of the type shown in FIG. 6, having a containment zipper of the type shown in FIG. 7, has the capability to seal against liquids, vacuum and air under pressure, the zipper ends must be hermetically sealed. U.S. patent application Ser. No. 10/896,769 disclosed a zipper end structure (called a "transition") that is bordered on three sides by fused material (i.e., ultrasonically welded sections of the upper and lower flanges and a thermally crushed section of the closure profiles). That "transition" (called a "transition area" herein) was disposed between a section of uncrushed ("as is") zipper and a section of crushed zipper. The "transition" in U.S. patent application Ser. No. 10/896,769 was formed by ultrasonically welding the respective sections of the closure profiles together without substantial deformation of the longitudinal profiled closure elements and then thermally crushing an intermediate portion of that ultrasonically welded zipper section.

The present invention also envisions the formation of a transition area that separates crushed closure profiles from uncrushed closure profiles. One method for accomplishing the foregoing will now be described.

Figure 9:
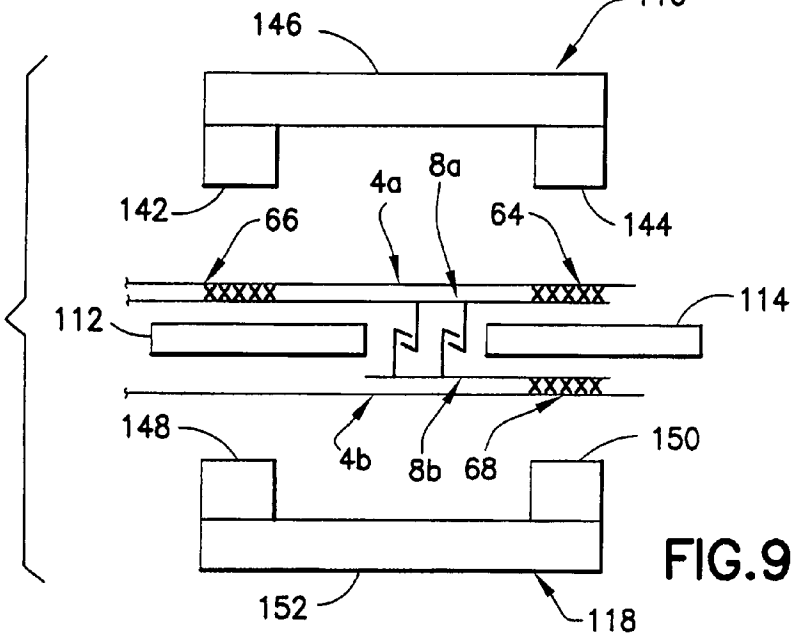
FIG. 9 is a drawing showing a side view of a machine station for joining a pair of zipper strips of the type seen in FIG. 7 to a web of web material in three places. The zipper and web material are not shown.

FIG. 9 is a drawing showing a side view of components of a zipper sealing station for joining a pair of zipper strips 8*a* and 8*b* of the type seen in FIG. 7 to respective sides 4*a* and 4*b* (shown only in part) of a folded web. This zipper sealing station comprises mutually opposed dual sealing bar assemblies 116 and 118. Dual sealing bar assembly 116 comprises mutually parallel sealing bars 142 and 144 fixed to and carried by a reciprocatable mounting plate 146; dual sealing bar assembly 118 comprises mutually parallel sealing bars 148 and 150 fixed to and carried by a reciprocatable mounting plate 152. The mounting plates are displaceable between extended and retracted positions by means of respective air cylinders (not shown), which are operated under the control of a programmable logic controller (PLC). A pair of zipper guide blades 112 and 114 are disposed with a gap therebetween in a plane midway between respective mutually opposed sets of sealing bars.

In accordance with one method of manufacture, the web is intermittently advanced in a machine direction and guided into a configuration whereby sides 4*a* and 4*b* of the web will be disposed between dual sealing bar assemblies 116 and 118 when web advancement ceases, i.e., during a dwell time. Concurrently with web advancement, the interlocked zipper strips 8*a* and 8*b* are also fed in the machine direction and guided by zipper guide blades 112 and 114 into the position seen in FIG. 9, wherein the lower flange of a length of zipper strip 8*a* is disposed between zipper guide blade 112 and sealing bar 142; the upper flange of said length of zipper strip 8*a* is disposed between zipper guide blade 114 and sealing bar 117*b*; and the upper flange of the same length of zipper strip 8*b* is disposed between zipper guide blade 114 and sealing bar 119*b*. The closure profiles are disposed in the gap between the zipper guide blades 112 and 114. The dual sealing bar assembly 118 also has a sealing bar 148, which need not be heated in the absence of a fourth zipper flange. The other sealing bars 142, 144 and 150 are heated.

The structure and operation of such sealing bars is well known. Typically, the sealing bar comprises a seal bar core having a pair of longitudinal channels that respectively house a thermocouple and an electric heater, both of which are electrically connected to a programmable heat controller by electrical wiring. The thermocouple produces electrical signals representing the temperature of the seal bar core, which signals are received by the heat controller. The heat controller controls the level of electrical current supplied to the heater in accordance with a heat control program that is designed to maintain the sealing bar temperature within limits preset by the system operator.

In accordance with the method of manufacture being described, first the sealing bars 142, 144 and 150 are heated to the desired temperatures. Then the mounting plates 146 and 152 are extended toward each in unison. FIG. 9 shows the mounting plates in retracted positions. In their extended positions (not shown), the heated sealing bar 144 presses the web portion 4*a* and the upper flange of zipper strip 8*a* against one side of zipper guide blade 114, while the heated sealing bar 150 presses the web portion 4*b* and the upper flange of zipper strip 8*b* against the other side of zipper guide blade 114. At the same time, the heated sealing bar 142 presses the web portion 4*a* and the lower flange of zipper strip 8*a* against one side of zipper guide blade 112, while the unheated sealing bar 148 (which acts as a backing) presses against the other side of zipper guide blade 112, thereby providing support for zipper guide blade 112. Heat and pressure are applied for a predetermined time. Then the mounting plates are retracted. During this operation, the web and zipper become joined in three band-shaped zones 64, 66 and 68. The foregoing zipper sealing operation is repeated at regular intervals, a package length section of containment zipper being heat sealed to a package length section of web material during each dwell time. In each interval between successive dwell times, the web/zipper assembly is advanced or indexed forward a distance equal to one package length.

If the web material is a solitary web of packaging film, then that web is folded before the zipper is attached. Alternatively, if the web material comprises two webs of packaging film, then the additional operation of heat sealing the bottoms of the receptacles can be performed before or after zipper attachment. A person skilled in the art will recognize, however, that the zipper strips could be separately attached to the web material and then brought into interlocking relationship while joined to the web material, in which case the arrangement shown in FIG. 9 would not be used.

After each zipper sealing operation is performed, the joined web and zipper are advanced by one package length. Each length of joined web and zipper must pass in succession through the stages depicted in FIG. 10, The web material is designated by numeral 4; the interlocked closure profiles are designated by numeral 128. The direction of web/zipper advancement (i.e., the machine direction) is indicated by the arrow.

Figure 11:
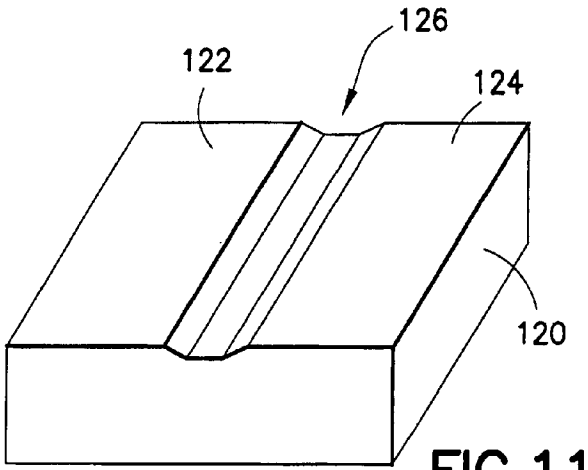
FIG. 11 is a drawing showing an isometric view of a grooved bar of a type that can be employed at those stations depicted in FIG. 10 whereat the closure profiles are not flattened.

At station 130, a short section of zipper having a small rectangular area is pressed between a first set of mutually opposing heated grooved bars (only one of which is visible in FIG. 10, the other being underneath the web 4) prior to side sealing. Each grooved bar at station 130 preferably has the same structure. FIG. 11 shows an exemplary grooved bar 120 having coplanar flat rectangular surfaces 122 and 124 of equal width, with a groove 126 therebetween. In this example, the groove 126 has a trapezoidal cross-sectional shape; however, the shape of the groove may be varied as a function of the outer profile of the particular zipper being employed.

When two heated grooved bars of the type shown in FIG. 11 are extended toward the zipper at station 130, a section of the closure profiles 128 is captured between the opposing grooves, which are designed to apply a gentle force to the profiles without substantial deformation and, in particular, without flattening the closure profiles. The flat surfaces of the grooved bars press the upper and lower flanges respectively. The height of each grooved bar may be approximately equal to the height of the zipper, meaning that the heated grooved bars are not intended to heat seal web material to web material, but rather are sized and positioned to act on the zipper. The grooved bars disclosed herein may be heated and displaced in ways similar to those described hereinabove for the zipper sealing bars.

At station 130, the temperature of the grooved bars is high, while the applied pressure is low. Under these conditions, the portions of the flanges trapped between the grooved bars are heated and softened, while the portions of the closure profiles trapped between the opposing grooves of the grooved bars are heated and softened without flattening. The area contacted by the grooved bars is similar to the cross-hatched area consisting of zones 18, 20, 22 seen in FIG. 4, wherein the closure profiles of the zipper section are disposed in zone 22.

Figure 10:
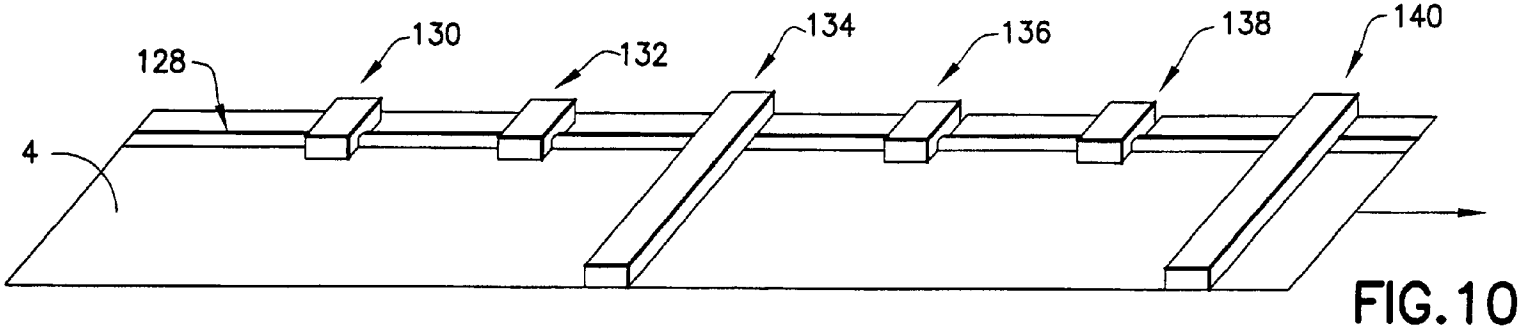
FIG. 10 is a drawing showing an isometric view of various stations in a machine that is set up to perform operations in a predetermined sequence in accordance with one method of manufacture.

At the start of the next work cycle, the web and zipper are indexed forward until the same zipper section that was pressed at station 130 arrives at station 132, where it is pressed between a second set of mutually opposing heated grooved bars (only one of which is visible in FIG. 10, the other being underneath the web 4). The grooved bars at station 132 may be arranged and configured substantially identically to the grooved bars at station 130. However, the grooved bars at station 132 are set up with a lower temperature and a slightly higher pressure than were in effect for the grooved bars at station 130. During operation of the grooved bars at station 132, the flanges of the zipper are again heated, this time to a point where flanges are melted. In the case of the specific zipper construction shown in FIG. 8, the extension 32 is also melted. In addition, the sections of the closure profiles trapped between the grooves of the grooved bars are again heated, causing further softening of this section of the closure profiles and melting in some places, most notably at the profiled closure elements that are furthest apart (see, e.g., posts 42 and 48 in FIG. 8). Again, the portions of the closure profiles trapped between the opposing grooves of the grooved bars are heated without flattening. The area contacted by the grooved bars at station 132 approximately overlies the area that was previously contacted by grooved bars at station 130.

At the start of the next work cycle, the web and zipper are again indexed forward until the same zipper section that was pressed at station 132 arrives at side sealing station 134. Station 134 comprises a pair of mutually opposing heated side sealing bars (only one of which is visible in FIG. 10, the other being underneath the web 4). The side sealing bars may be similar in construction to the previously described zipper sealing bars, but are oriented perpendicular to the zipper instead of parallel, and have a length equal to the height instead of the length of a package. Each of the side sealing bars is flat, without grooves that would provide clearance for the zipper closure profiles. The width of the side sealing bars must be less than (e.g., ⅔) the width of the grooved bars at stations 130 and 132. The zipper section should be placed such that its centerline is approximately aligned with the centerlines of the side sealing bars.

At station 134, the bag side seals are formed by extending the heated side sealing bars so that the zipper/web assembly is pressed therebetween. The side sealing bars at station 134 will melt intervening portions of the web and zipper material. Since the zipper section has been preheated at stations 130 and 132, the side sealing bars will readily crush, i.e., flatten, the intervening zipper portions, including the intervening portions of the closure profiles. More precisely, the side sealing bars flatten an intermediate portion of the zipper area previously contacted by the grooved bars at stations 130 and 132. The side seal region will be similar to the cross-hatched region 14 seen in FIG. 5, with zones 22*a* and 22*b* again representing respective transition areas on opposite sides of the side seal region. Depending on the composition of the film being used, side sealing may involve one or more operations performed by respective sets of side sealing bars located at different stations in the machine.

At the start of the next work cycle, the web and zipper are again indexed forward until the same zipper section that was partially flattened at station 134 arrives at station 136, where it is pressed between a third set of mutually opposing heated grooved bars (only one of which is visible in FIG. 10). The grooved bars at station 136 may be arranged and configured substantially identically to the grooved bars at stations 130 and 132. However, the grooved bars at station 132 are set up with a lower temperature and a higher pressure than were in effect for the grooved bars at station 132. During operation of the grooved bars at station 136, any dams of plastic created by the side sealing bars on the flanges of the zipper are flattened.

Again, the portions of the closure profiles trapped between the opposing grooves of the grooved bars at station 136 are not flattened. The area contacted by the grooved bars at station 136 approximately overlies the area that was previously contacted by grooved bars at station 132. During the application of heat and pressure by the third set of grooved bars, the transition areas will reside in the gap between the mutually confronting grooves on the bars, and thus will not be flattened.

In accordance with the preferred method of manufacture, all of the heated areas are then cooled by being placed in contact with surface of chilled or unheated bars. This can be done in two separate operations or in a single operation given a properly designed cooling bar. FIG. 10 illustrates an embodiment wherein cooling is done at two stations 138 and 140 as follows:

At the start of the next work cycle, the web and zipper are again indexed forward until the same zipper section that was pressed at station 136 arrives at the first cooling station 138, where it is pressed between a fourth set of mutually opposing chilled or unheated grooved bars (only one of which is visible in FIG. 10). The grooved bars at station 138 may be arranged and configured substantially identically to the grooved bars at station 136. Again, the portions of the closure profiles trapped between the opposing grooves of the grooved bars at station 138 are not flattened. The area contacted by the grooved bars at station 138 approximately overlies the area that was previously contacted by grooved bars at station 136. During the application of pressure by the fourth set of grooved bars, the transition areas will reside in the gap between the mutually confronting grooves on the bars, and thus will not be flattened. The grooved bars at station 138 act as heat sinks, extracting heat from the previously heated thermoplastic material. The material thus cooled would include the upper and lower flanges in the heat-treated zipper section as well as the transition areas.

At the start of the next work cycle, the web and zipper are again indexed forward until the same zipper section that was cooled at station 138 arrives at the second cooling station 140. Station 140 comprises a pair of mutually opposing chilled or unheated side cooling bars (only one of which is visible in FIG. 10, the other being underneath the web 4). The side cooling bars are similar in size and shape to the previously described side sealing bars. More specifically, the side cooling bars at station 140 have the same width as that of the side sealing bars at station 134. Each of the side cooling bars is flat, without grooves that would provide clearance for the zipper closure profiles. The zipper section should be placed such that its centerline is approximately aligned with the centerlines of the side cooling bars. This second cooling operation involves placing the chilled or unheated flat cooling bars in contact with the entire side seal region, including the flattened zone between the transition areas (22*a* and 22*b* in FIG. 5), but not including the transition areas, which are left undisturbed.

The cooling stations achieve the desired final formation of the transition area and adjacent areas. Thereafter, the zipper/web assembly is again indexed forward. During the next work cycle, the zipper and web material are cut along a line generally bisecting the side seal region formed at station 134.

Alternatively, a set of cooling bars could be designed to contact all of the foregoing areas (i.e., the areas contacted by the grooved bars as well as the area contacted by the side sealing bars) in one operation. In this case, each cooling bar would have a flat surface comprising a first area in the shape of an H on its side and a second area, substantially contiguous with the first area and extending downward from the side of the H. The H-shaped surface area would be defined by respective recesses that provide clearance for the transition areas and has a width equal to the width of the heat-treated zipper section, while the second area has a width equal to the width of the side seal region.

Figure 12:
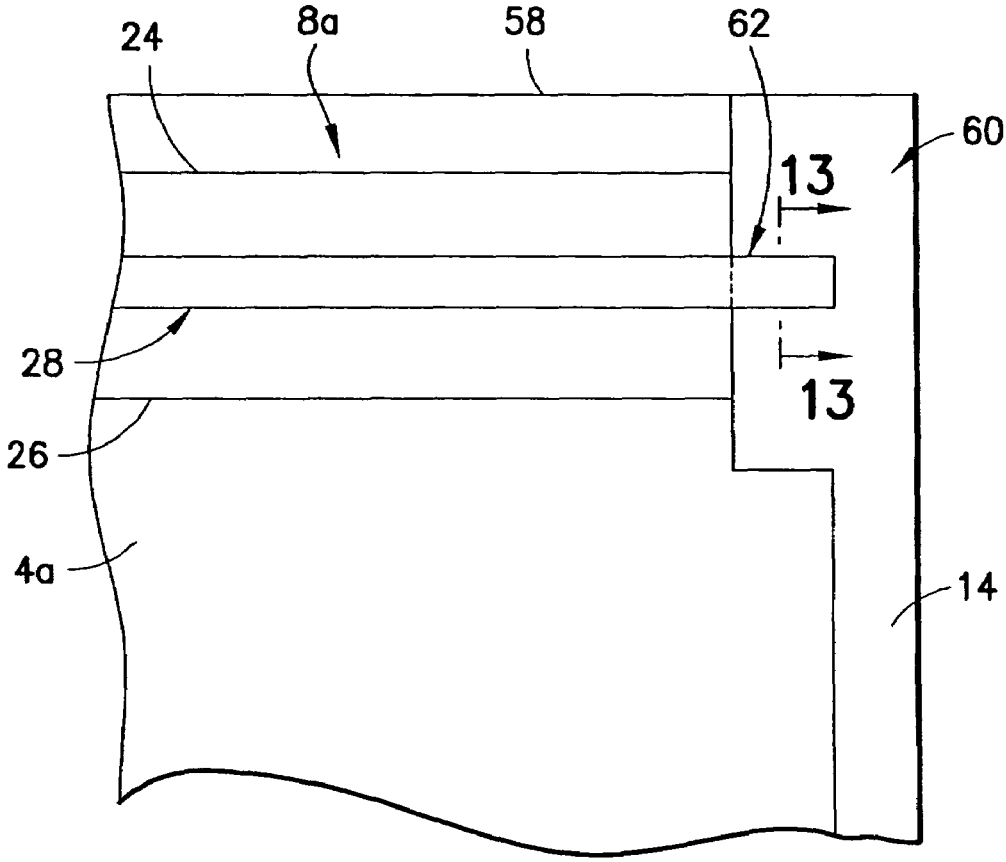
FIG. 12 is a drawing showing a front view of an upper corner of a reclosable bag in accordance with the embodiment shown in FIG. 6 and incorporating a zipper of the type shown in FIG. 7.

The result of the foregoing operations is seen in FIG. 12, which shows a corner of a reclosable bag (of the type shown in FIG. 6) having a containment zipper (of the type shown in FIG. 7). For the purpose of illustration, it is presumed that the front panel 4*a* is optically transparent and that the front zipper strip (comprising a closure profile 28, an upper flange 24 and a lower flange 26) is visible behind the front panel 4*a*. The front panel 4*a* of the receptacle extends above the upper flange 24 of the zipper strip 8*a* and has a top edge 58. The rear bag panel is directly behind the front panel and extends upward to the same elevation as the front panel (see FIG. 6). The side seal 14 extends the full height of the front panel 4*a*. A transition area 62, comprising respective sections of the closure profiles that are at least partly joined together, is connected at one end to an uncrushed portion of the closure profiles and is substantially contiguous at the other end with the side seal 14. The areas above and below the transition area 62, and the uppermost portion of side seal 14 adjacent thereto (and adjacent to the transition area 62) forms a flattened area generally indicated by arrow 60 in FIG. 12. The web and zipper materials are melded together in region 60.

Figure 13:
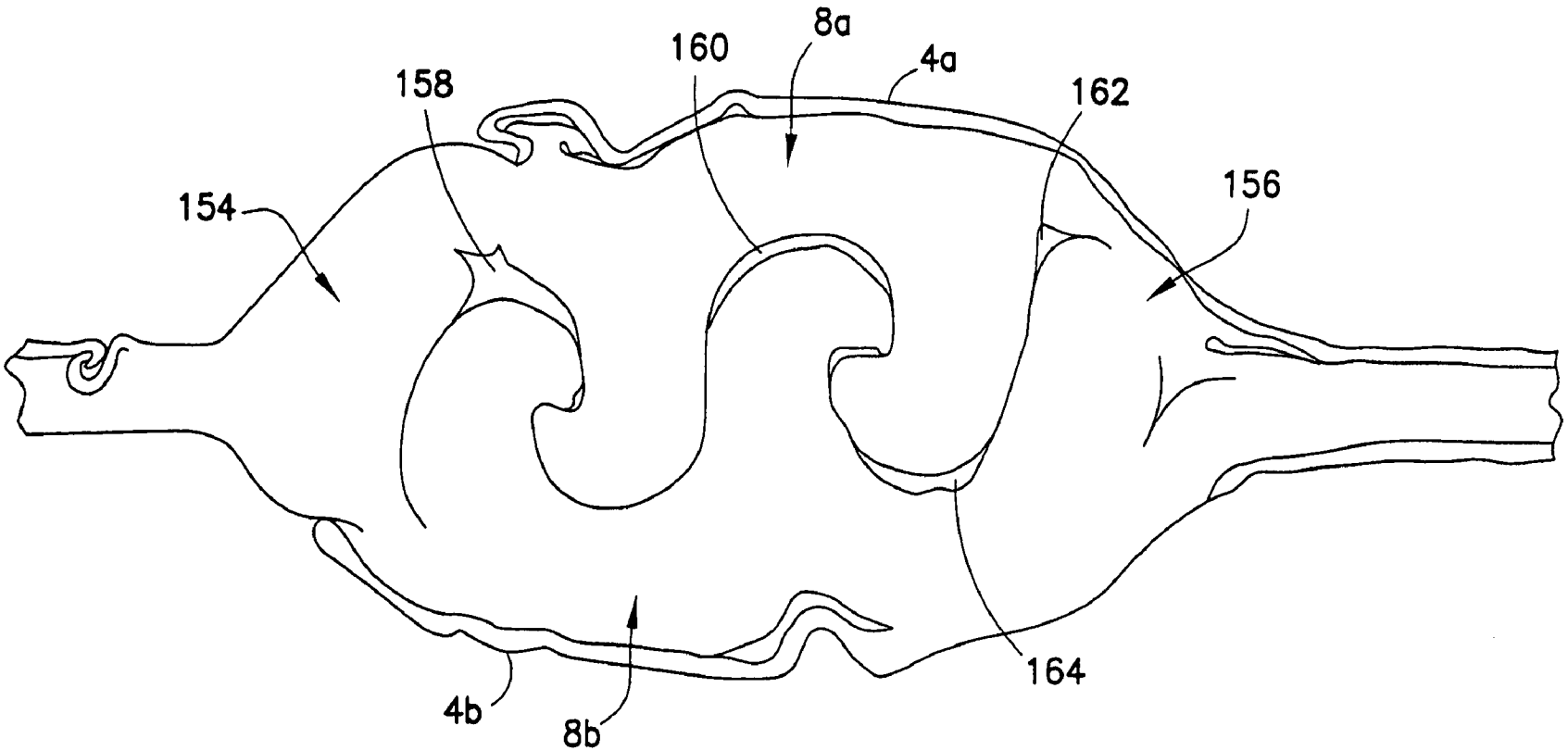
FIG. 13 is a drawing showing a cross-sectional view of the closure profiles in a transition area of the zipper incorporated in the bag depicted in FIG. 9, the section being taken along dashed line 10-10 seen in FIG. 9.

In accordance with one methodology, the temperature and pressure of the grooved bars at stations 130, 132, 136 and 138 are such that the transition area 62 has a cross section as shown in FIG. 13. The view presented in FIG. 13 is taken along section line 13-13 indicated in FIG. 12. FIG. 13 shows two areas 154 and 156 where the zipper strips 8*a* and 8*b* have been fused or melded together. Although the separate components are no longer visible in FIG. 13, each fused region 154 and 158 represents a region where a post and a portion of the adjoining flange of one zipper strip has been fused with confronting portions of the other zipper strip. For example, the fused region 154 seen in FIG. 13 was formed by fusing portions of post 48 and flanges 24 and 30 seen in FIG. 8. Similarly, the fused region 156 seen in FIG. 13 was formed by fusing portions of post 42, flange 26 and extension 32 seen in FIG. 8. FIG. 13 shows that the hooks of the monohook elements of zipper strips 8*a* and 8*b* have not been fused together in the area where the section was taken. The channels 158, 160, 162 and 164 seen in FIG. 13 do not produce leakage through the end of the zipper because they are closed off in the region of transition area 62 that is substantially contiguous with the portion of the side seal 14 where the closure profiles were crushed.

However, the transition area 62 may be formed in a manner such that the hooks of the monohook elements are fused together and there are no channels like those depicted in FIG. 13.

One of the problems in producing an acceptable containment package occurs with mismatched packaging elements. If the zipper is massive compared to the film, or the zipper requires a high amount of energy relative to the film to produce a seal, the transition area of the zipper crush must be formed with care to avoid leakage. In accordance with alternative embodiments, the contact area in the section of the closure profiles wherein the transition areas will be formed may be coated with a lower-melting-point material that allows for the adhesion of the zipper to itself in the transition areas using a lower heat setting. Consequently, film damage is reduced while still creating a leakproof zipper end seal and eliminating or reducing the possibility of cross-channel leakers. The coating can be made of a material that is activated by thermal, ultrasonic, radiofrequency or ultraviolet energy, which would be applied at the point in the zipper profile where it is desired to fuse and weld the profiles to create an acceptable containment seal. The advantage of this is that the heat used can be lowered in the stomp area, thereby helping to minimize or eliminate film damage while still creating a hermetic side seal. This allows for the combination of mismatched packaging elements with the introduction of the coating material onto the zipper profiles. By adding a lower-energy material to the profile, one can effectively circumvent the problems associated with the combination of massive (high-energy) zippers and thin (low-energy) films. The coating would have a lower energy requirement than the base zipper material, thereby more closely matching to a lower-energy film substrate.

Figure 14:
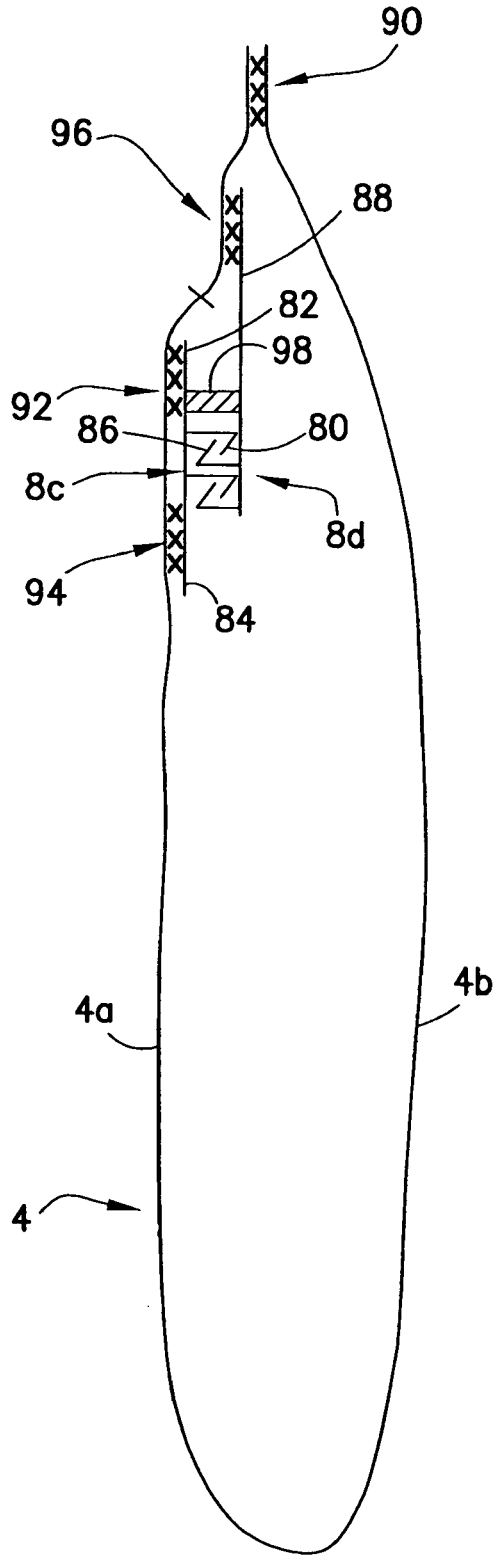
FIG. 14 is a drawing showing a schematic representation of the cross section of a reclosable bag for vacuum, pressure or liquid containment in accordance with another embodiment of the invention.

A reclosable pouch or bag in accordance with another embodiment of the invention is schematically represented in cross section in FIG. 14. The reclosable bag comprises a receptacle 4 with a three-flange containment zipper installed on the front panel 4*a* of the bag. The zipper extends the full width of the bag, with the ends of the zipper being blended into the side seals (not shown in FIG. 14). A top seal 90 joins respective marginal portions of the front and rear panels 4*a* and 4*b* at the top of the bag. Although FIG. 14 shows a receptacle formed by folding a solitary web of packaging film and then cross sealing, the front and rear panels could alternatively be formed by separate webs, in which case the bag would also include a bottom seal joining respective bottom marginal portions of the front and rear panels.

Still referring to FIG. 14, one strip of the containment zipper comprises a closure profile 80 and upper and lower flanges 82 and 84 extending in opposite directions from closure profile 80. The upper and lower flanges 82 and 84 are heat sealed to the front panel 4*a* in respective band-shaped zones 92 and 94. The other zipper strip comprises a closure profile 86 and an upper flange 88 having a length substantially greater than upper flange 82. A portion of upper flange 88 that extends beyond upper flange 82 is heat sealed to the front panel 4*a* in a band-shaped zone 96. The band-shaped zones 92, 94 and 96 extend in parallel for the length of the zipper, with zone 92 disposed between zones 94 and 96.

The structure of the containment zipper attached to front panel 4*a* is only schematically represented in FIG. 14. The structure of an exemplary containment zipper, suitable for incorporation in the bag seen in FIG. 14, is shown in detail in FIG. 15. The intimate contact area between the respective closure profiles lies within the aforementioned percentage range that is suitable for use as a containment zipper. One zipper strip 8*c* comprises a closure profile 80 and upper and lower flanges 82 and 84 extending in opposite directions therefrom. The upper flange 82 is longer than the lower flange 84 in the elevational direction. The closure profile 80 comprises a pair of monohook elements and a post or backup element devoid of a hook. A portion of the outer surface of upper flange 82 is coated with a sealant layer 102 to facilitate heat sealing of the upper flange 102 to the front panel 4*a*. The lower flange 84 has a similar sealant layer 100 on its outer surface. The other zipper strip 8*d* comprises a closure profile 86 and an upper flange 88 having a length substantially greater than the length of upper flange 82. Zipper strip 8*d* has no lower flange. The closure profile 86 also comprises a pair of monohook elements and a post or backup element devoid of a hook. In this particular containment zipper embodiment, the respective posts are the profile elements that are furthest apart from each other. A portion of the inner surface of upper flange 88 is coated with a sealant layer 104 to facilitate heat sealing of the upper flange 88 to the front panel.

Figure 15:
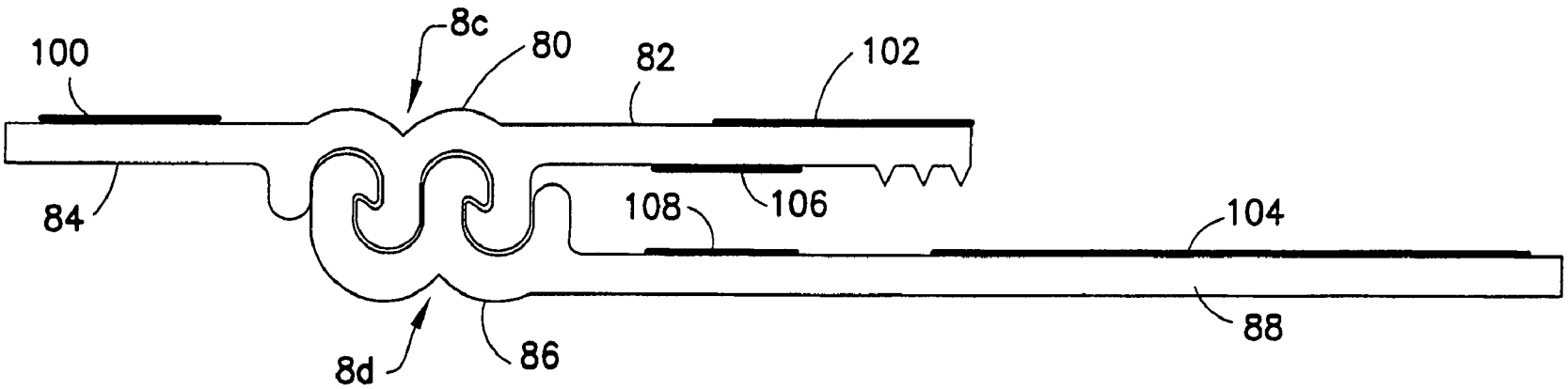
FIG. 15 is a drawing showing a cross-sectional view of a zipper that is suitable for use as a containment zipper in bags of the type schematically depicted in FIG. 14.

The zipper shown in FIG. 15 further comprises a layer 106 of peelable sealing material applied on the interior surface of upper flange 82 of zipper strip 8*c* and a layer 108 of peelable sealing material applied on the interior surface of upper flange 88 of zipper strip 8*d*. The layers of peelable sealing material have the same width and extend the full length of the zipper strips, and are placed in mutual opposition to each other.

In accordance with one method of manufacturing reclosable bags or pouches of the type depicted in FIG. 14, the zipper is attached to a web of packaging film before the web is folded. Before the zipper is attached to the web, the layers 106 and 108 are pressed together and heated to a degree that the layers of peelable sealing material form a peel seal (item 98 in FIG. 14). After the peel seal has been activated, the zipper is attached to the web of packaging film by pressing and heating the sealant layers 100, 102 and 104 (seen in FIG. 15) while in contact with the web using sealing bars under temperature/pressure conditions such that the sealant material and web are heat sealed together, thereby forming the band-shaped zones 94, 92 and 96 seen in FIG. 14. Then the web is folded so that its lateral edges are aligned above the zipper, where the top seal 90 will be formed later. Before the top seal is formed, however, the web/zipper assembly must be cross sealed in a manner similar to that previously described with reference to the embodiment shown in FIG. 6. The same steps, as previously described with reference to FIG. 10, can be performed using similar apparatus, with the difference that the grooved bars must be specifically designed so that the grooves capture and do not flatten the closure profiles 8*c* and 8*d* seen in FIG. 15. Also the flat surfaces of the grooved bars must be sized to extend from the edge of flange 82 to its connection with closure profile 80 and from the edge of flange 84 to its connection point with closure profile 80 (see FIG. 15), i.e., portions of flange 88 that extend above flange 82 need not be included within the extent of the zipper end seals. Under the appropriate operating conditions, sections of closure profiles 80 and 86 can be formed into transition areas having a cross section similar to what is depicted in FIG. 13, except that zipper strip 8*d* does not have an extension similar to extension 32 of zipper strip 8*b* shown in FIG. 7. However, such an extension could be provided if desired.

After the cross seals and zipper end seals have been formed, the bag or pouch shown in FIG. 14 can be filled with product. After filling, a band-shaped zone of web-to-web joinder 90 is formed at the top of the bag or pouch by conventional heat sealing. The web/zipper assembly is cut along successive side seal regions to form a separate bag or pouch.

The result of the foregoing process is a reclosable bag or pouch having a zipper attached to the front panel and extending the full width of the bag or pouch. A line of weakness, e.g., a line of spaced perforations, is formed in the front panel 4*a* at a point between the zones of web-zipper joinder 92 and 96, as indicated by the short line seen intersecting front panel 4*a* in FIG. 14. The line of weakness can be formed before or after the zipper is attached to the web. A consumer can gain access to the contents of the unopened bag or pouch by tearing the front panel 4*a* along the line of weakness, peeling open the peel seal 98 and then pulling the zipper strips apart to open the zipper.

With the ends of the zipper sealed using the techniques disclosed herein, the bag or pouch shown in FIG. 14 can be rendered suitable for containing vacuum, pressure or liquid without leaking, even after the bag or pouch has been opened and reclosed. By sealing the zipper to the front panel instead of to both panels, the zipper will be exposed to less stress under pressure. More specifically, by placing the zipper on the front panel, forces due to internal pressure will act perpendicularly to the zipper and all in one direction. With all the force acting on the zipper in one direction, resistance to opening will be maximized. The front panel design is also effective in transferring the stresses of the internal pressure to the film and away from the zipper. Higher internal pressures can be accommodated to the point where the package film fails before the zipper closure fails.

The transition area between crushed and non-crushed closure profiles needs to be correctly formed for containment applications. To successfully form a tight transition area, the pouch or bag machine can be set up with grooved bars that are specially designed for the particular zipper being employed. Although FIG. 10 shows three stations 130, 132 and 136 having heated grooved bars for softening and/or melting portions of the zipper profiles and flanges, the number of stations used to form the leakproof zipper end seal will not be the same for all machines and film structures. Moreover, the temperature and pressure settings for the heated grooved bars will be based on different line speeds, available dwell times, film structures and machine types.

Alternatively, tight transition zones can be formed using ultrasonic energy instead of conductive heat. In that case, each set of heated grooved bars would be replaced by a respective horn/anvil pair, in which the horn emits ultrasonic energy, and both the horn and anvil have grooves that provide clearance for the sections of closure profiles disposed between the horn and anvil. Welding and sealing of thermoplastic material by ultrasonic vibrations is an established process and has been used for forming slider end stops on the ends of a slider-operated zipper in a reclosable bag and for forming zipper joints generally. A typical ultrasonic welding apparatus in which a workpiece is fed through an ultrasonic weld station comprises an anvil and an oppositely disposed resonant horn. The frontal surface of the horn and the anvil are urged toward mutual engagement, for coupling the ultrasonic vibrations from the activated horn into the thermoplastic material of the workpiece, thereby effecting ultrasonic welding. The horn is energized from a power supply that provides electrical high-frequency power at a predetermined ultrasonic frequency to an electro-acoustic transducer, which, in turn, provides mechanical vibrations at that frequency to a booster or coupling horn for coupling these vibrations to the horn.

Although not shown in FIG. 6 or FIG. 14, a one-way valve of the type shown in FIG. 1 (item 6) may be installed in the front panel of the bags respectively depicted in FIGS. 6 and 14 to allow the interior volume of the bag to be evacuated after the zipper has been reclosed.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "joined" means that distinct surfaces of respective portions of thermoplastic material have been brought into contact and softened or melted to an extent that those surfaces are no longer distinct and the portions of material have or will become integral with each other after sufficient cooling. As used in the claims, the term "web material" means one or more webs of flexible material suitable for making a package. As used in the claims, the term "melted", in the context of material of either a zipper flange or a closure profile "melting", means some or all of the material of the particular flange or closure profile has melted. As substantially used in the claims, the concept of "a volume occupied by a structural element" should not be construed to require that the volume contain no empty space or that the volume contain no other structural element. Further, in the absence of explicit language in any method claim setting forth the order in which certain steps should be performed, the method claims should not be construed to require that steps be performed in the order in which they are recited.

The invention claimed is:

1. A method of manufacture comprising the following steps:

(a) joining first and second zipper strips of a plastic zipper to web material, said first zipper strip comprising a first closure profile and a first flange extending from said first closure profile, said second zipper strip comprising a second closure profile and a second flange extending from said second closure profile, said first and second closure profiles in combination comprising at least three projecting elements, and said first zipper strip further comprising a third flange extending from said first closure profile in a direction opposite to that of said first flange, said first through third flanges being joined to said web material;

(b) before or after step (a) has been performed, arranging said web material such that first and second sections are mutually opposed;

(c) after steps (a) and (b) have been performed, applying heat and pressure or ultrasonic vibrations and pressure along first and second zones that are substantially orthogonal to said joined zipper strips and extend at least from said zipper strips to the portions of said first and second sections of said web material that are furthest away from said zipper strips, the heat and pressure or ultrasonic vibrations and pressure being sufficient to melt the portions of said web material that lie within said first and second zones, and to melt and flatten the portions of said zipper that lie within said first and second zones;

(d) before step (c) is performed, applying heat and pressure or ultrasonic vibrations and pressure in first and second transition regions having intermediate portions that will be respectively overlapped by said first and second zones in step (c), heat and pressure or ultrasonic vibrations and pressure being applied to an extent that upon completion of step (d), the projecting elements of said closure profiles that are furthest apart from each other will become fused to respective portions of the other zipper strip in said first and second transition regions, and said first and second closure profiles will be heated but not flattened in said first and second transition regions, wherein upon completion of steps (c) and (d), said unflattened portions of said first and second closure profiles in said first transition region form first and second transition areas on opposite sides of a first flattened section of said first and second closure profiles, and said unflattened portions of said first and second closure profiles in said second transition region form third and fourth transition areas on opposite sides of a second flattened section of said first and second closure profiles;

(e) after step (c) has been performed, applying pressure in said first and second transition regions to an extent that surface irregularities formed on said first through third flanges during step (c) are flattened without flattening said first through fourth transition areas; and (f) cutting said web material and said first and second zipper strips along first and second lines that respectively intersect said first and second zones and extend the full height of said web material.

2. The method as recited in claim 1, wherein heat or ultrasonic vibrations are also applied in said first and second transition regions during step (e).

3. The method as recited in claim 1, further comprising the step of removing heat from said first and second transition regions subsequent to step (e) and prior to step (f).

4. The method as recited in claim 1, wherein said first and second sections of said web material are parts of a single web, and step (b) further comprises the step of folding said web, said fold being located such that said first and third flanges are joined to said web material on one side of said fold, and said second flange is joined to said web material on the other side of said fold.

5. The method as recited in claim 1, wherein said first and second sections of said web material are parts of a single web, and step (b) further comprises the step of folding said web, said fold being located such that said first, second and third flanges are joined to said web material on one side of said fold.

6. The method as recited in claim 1, wherein:

said first section of said web material is part of a first web, and said second section of said web material is part of a second web;

step (b) further comprises the step of heat sealing respective marginal portions of said first and second webs together in a third zone that connects said first and second zones; and during step (a), said first and third flanges are joined to said first web only, while said second flange is joined to said second web only.

7. The method as recited in claim 1, wherein:

said first section of said web material is part of a first web, and said second section of said web material is part of a second web;

step (b) further comprises the step of heat sealing respective marginal portions of said first and second webs together in a third zone that connects said first and second zones; and during step (a), said first, second and third flanges are joined to said first web only.

8. The method as recited in claim 1, further comprising the following steps:

coating surfaces of said first and second closure profiles with a lowermelting-point material, the coating being applied on portions of the surfaces of said first and second closure profiles that will be in contact when said first and second closure profiles are interlocked; and interlocking said first closure profile with said second closure profile subsequent to said coating step.

9. A method of manufacture comprising the following steps:

(a) interlocking a first closure profile of a length of a first zipper strip made of thermoplastic material with a second closure profile of an equal length of a second zipper strip made of thermoplastic material, said first and second zipper strips respectively further comprising first and second flanges respectively extending in the same direction from said first and second closure profiles, and said first zipper strip further comprising a third flange extending in a direction opposite to the direction in which said first flange extends;

(b) joining said first through third flanges of said lengths of said first and second zipper strips to first through third portions respectively of a web material along first through third band-shaped zones of joinder respectively;

(c) after steps (a) and (b) have been performed, supplying energy into first, second and third volumes forming a first section of said lengths of said first and second zipper strips, said third volume being disposed between said first and second volumes, said third volume being occupied by respective first sections of said first and second closure profiles, said first volume being occupied by respective first sections of said first and second flanges, and said second volume being occupied by a first section of said third flange, wherein said respective first sections of said first and second closure profiles are heated without being flattened during step (c) and said respective first sections of said first and second flanges will become joined upon completion of step (c);

(d) after step (c) has been performed, applying pressure to and supplying energy over a first side seal region that intersects intermediate portions of said first sections of said first and second closure profiles and said first through third flanges and that intersects mutually confronting fourth and fifth portions of said web material, whereby said fourth and fifth portions of said web material will become joined to each other and to said intermediate portion of said first section of said third flange, and said intermediate portions of said first sections of said first and second closure profiles are flattened;

(e) after step (d) has been performed, applying pressure on said respective first sections of said first and second flanges without flattening any unflattened portions of said first sections of said first and second closure profiles; and (f) after step (e) has been performed, cutting said web material and said first and second zipper strips along a first line that intersects and extends the full height of said first side seal region.

10. The method as recited in claim 9, further comprising the following steps:

(g) after steps (c) has been performed, supplying energy into fourth, fifth and sixth volumes forming a second section of said lengths of said first and second zipper strips, said sixth volume being disposed between said fourth and fifth volumes, said sixth volume being occupied by respective second sections of said first and second closure profiles, said fourth volume being occupied by respective second sections of said first and second flanges, and said fifth volume being occupied by a second section of said third flange, wherein said respective first sections of said first and second closure profiles are heated without being flattened during step (g) and said respective second sections of said first and second flanges will become joined upon completion of step (g);

(h) after step (g) has been performed, applying pressure to and supplying energy over a second side seal region that intersects intermediate portions of said second sections of said first and second closure profiles and said first through third flanges and that intersects mutually confronting sixth and seventh portions of said web material, whereby said sixth and seventh portions of said web material will become joined to each other and to said intermediate portion of said second section of said third flange, and said intermediate portions of said second sections of said first and second closure profiles are flattened;

(i) after step (h) has been performed, applying pressure on said respective second sections of said first and second flanges without flattening any unflattened portions of said second sections of said first and second closure profiles; and (j) after step (i) has been performed, cutting said web material and said first and second zipper strips along a second line that intersects and extends the full height of said second side seal region, wherein said first and second lines are separated by a distance equal to one package width.

11. The method as recited in claim 9, wherein step (c) comprises first and second operations, said second operation being performed subsequent to said first operation, a first amount of energy being supplied into said first through third volumes during said first operation of step (c), and a second amount of energy being supplied into said first through third volumes during said second operation of step (c).

12. The method as recited in claim 9, wherein step (e) comprises first and second operations, said second operation being performed subsequent to said first operation, energy being supplied into said first through third volumes during said first operation of step (e), and energy not being supplied into said first through third volumes during said second operation of step (e).

* * * * *